US007356285B2

(12) United States Patent
Kim et al.

(10) Patent No.: US 7,356,285 B2
(45) Date of Patent: Apr. 8, 2008

(54) IMAGE FORMING APPARATUS AND A DRIVING METHOD FOR THE SAME HAVING CONCURRENTLY STOPPING MOTORS

(75) Inventors: Young-min Kim, Suwon-si (KR); Byung-sun Ahn, Suwon-si (KR); Sang-cheol Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 39 days.

(21) Appl. No.: 10/974,786

(22) Filed: Oct. 28, 2004

(65) Prior Publication Data

US 2005/0163534 A1 Jul. 28, 2005

(30) Foreign Application Priority Data

Jan. 28, 2004 (KR) ..... 10-2004-0005366

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS

2003/0016965 A1* 1/2003 Matsumoto ..... 399/167

FOREIGN PATENT DOCUMENTS

| | | | |
|---|---|---|---|
| JP | 55018841 A | * | 2/1980 |
| JP | 60245359 A | * | 12/1985 |
| JP | 7-247044 | | 9/1995 |
| JP | 9-30703 | | 2/1997 |
| JP | 2001013842 A | * | 1/2001 |
| JP | 2003276895 A | * | 10/2003 |
| KR | 2000-34874 | | 6/2000 |
| KR | 2000-53532 | | 8/2000 |

* cited by examiner

*Primary Examiner*—Quana Grainger
(74) *Attorney, Agent, or Firm*—Staas & Halsey LLP

(57) ABSTRACT

An image forming apparatus including a first driving section having a feed mechanism and a printer engine, a second driving section having a delivery mechanism, a first motor, a second motor, and a controller. The first and second motors drive the first and second driving sections, respectively. The power supplied to one of the first and second motors having a higher output is cut off earlier by a predetermined compensation time as compared to the other motor having a lower output. The compensation time is equal to or shorter than the difference $|T_1-T_2|$ between a first stop time $T_1$ required to actually stop the first motor after cut-off of the power supplied to the first motor and a second stop time $T_2$ required to actually stop the second motor after cut-off of the power supplied to the second motor.

11 Claims, 4 Drawing Sheets

IMAGE FORMING APPARATUS AND A DRIVING METHOD FOR THE SAME HAVING CONCURRENTLY STOPPING MOTORS

CROSS-REFERENCE TO RELATED APPLICATIONS

This application claims the benefit of Korean Application No. 2004-5366, filed Jan. 28, 2004, in the Korean Intellectual Property Office, the disclosure of which is incorporated herein by reference.

BACKGROUND OF THE INVENTION

1. Field of the Invention

The present invention relates to an image forming apparatus, and more particularly to an image forming apparatus having an optimized driving mechanism and a method of driving the same.

2. Description of the Related Art

As generally known in the art, an image forming apparatus refers to a printing machine, such as a photocopier, a printer or a facsimile machine, to output image data onto a printing medium such as a paper. The image forming apparatus includes a housing, a printer engine mounted within the housing to develop an image onto a paper, a variety of rollers mounted along a predetermined paper path within the housing, and a driving mechanism to drive the printer engine.

The driving mechanism includes a driving source and a power transfer unit to transfer power generated from the driving source to the printer engine and the variety of rollers.

In general, the number and type of a driving source or driving sources used for an image forming apparatus vary depending on the size of the image forming apparatus and the number of components of the apparatus. For example, a small-sized image forming apparatus can drive a printer engine and a plurality of rollers using a single driving source. Such a small apparatus can reduce the manufacturing cost by adopting a low-output motor. On the other hand, an image forming apparatus having a printer engine with a greater driving load and a relatively large number of rollers generally uses two or more motors having a high output.

It is a current trend that the number of components provided in an image forming apparatus is increasing to implement various functions, such as duplex-printing and color-printing, thereby resulting in an increase of the driving load of the image forming apparatus. Accordingly, studies are under progress to provide an optimized driving mechanism by disposing a plurality of motors, including a high-output motor with low control capability and a low-output motor with high control capability, in proper positions within an image forming apparatus.

SUMMARY OF THE INVENTION

Accordingly, it is an aspect of the present invention to solve at least the above problems and/or disadvantages and to provide at least the advantages described below.

It is another aspect of the present invention to provide an image forming apparatus using both a motor with a high output characteristic and a motor with a high control capability to realize an optimized driving mechanism, and a method of driving the same.

Additional aspects and/or advantages of the invention will be set forth in part in the description which follows and, in part, will be obvious from the description, or may be learned by practice of the invention.

The foregoing and/or other aspects are achieved by providing an image forming apparatus including a first driving section having a feed mechanism and a printer engine, a second driving section having a delivery mechanism, a first motor, a second motor, and a controller. The first and second motors drive the first and second driving sections, respectively. The power applied to one of the first and second motors having a higher output is cut off earlier by a predetermined compensation time as compared to a power applied to the other motor having a lower output.

In the image forming apparatus having the structure as explained above, the compensation time should be equal to or shorter than the difference $|T_1-T_2|$ between a first stop time $T_1$ required to actually stop the first motor after cut-off of the power supplied to the first motor and a second stop time $T_2$ required to actually stop the second motor after cut-off of the power supplied to the second motor. The first motor has a higher output than the second motor.

A BLDC motor is used as the first motor, and a stepping motor is used as the second motor. The printer engine includes a photoconductive drum, a developing roller and a transfer roller. The second driving section may additionally include a fusing roller.

The foregoing and/or other aspects are also achieved by providing a method of driving an image forming apparatus, characterized in that the driving of the image forming apparatus is stopped by cutting off a power supplied to a motor having a higher output earlier by a predetermined compensation time as compared to a power supplied to a motor having a lower output.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENT

Figure 1:
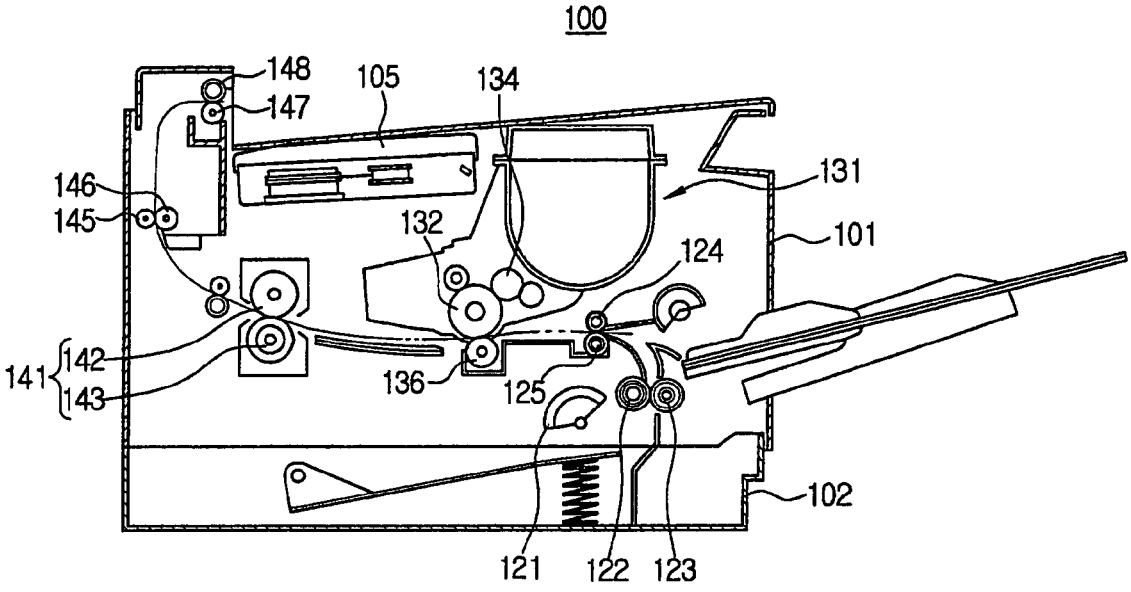
FIG. 1 is a cross-sectional side view showing the structure of an image forming apparatus according to an embodiment of the present invention.

Reference will now be made in detail to the embodiment of the present invention, an example of which is illustrated in the accompanying drawings, wherein like reference numerals refer to the like elements throughout. The embodiment is described below to explain the present invention by referring to the figures.

Figure 2:
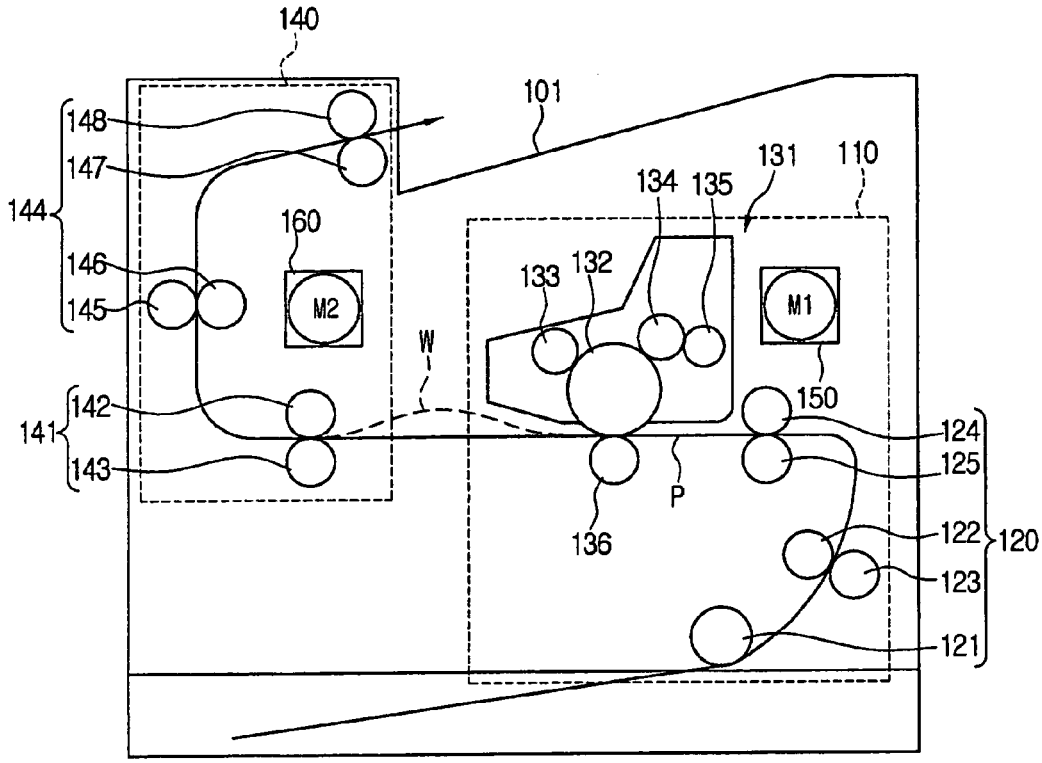
FIG. 2 is a schematic view showing the structure of the image forming apparatus of FIG. 1.
Figure 3:
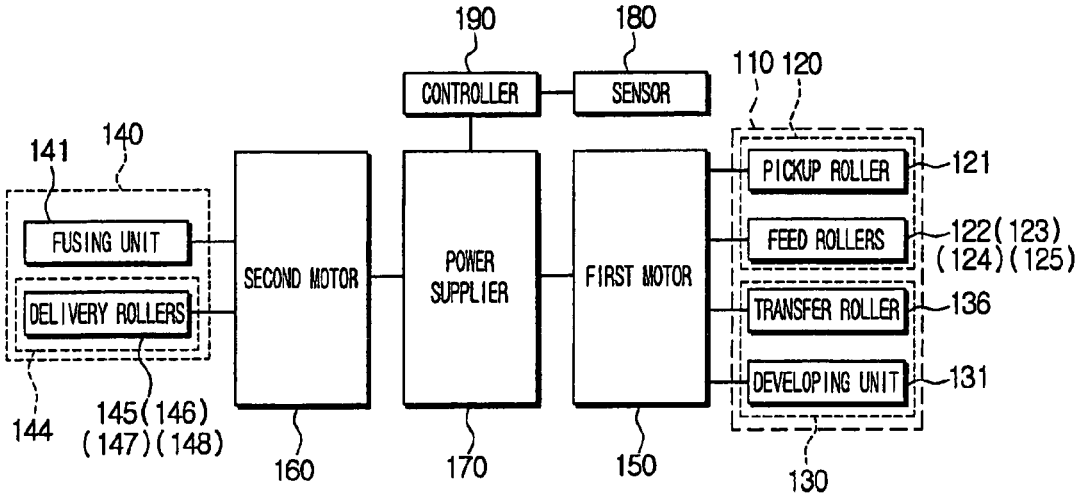
FIG. 3 is a block diagram showing the structure of the image forming apparatus of FIG. 1.

Referring to FIGS. 1 to 3, an image forming apparatus 100 according to an embodiment of the present invention includes a first driving section 110, a second driving section 140, a first motor 150, a second motor 160, a power supplier 170, a sensor 180 and a controller 190.

A housing 101 forms the exterior structure of the image forming apparatus 100. A paper cassette 102 to load a plurality of paper sheets is removably mounted at the lower part of the housing 101. Also, a paper path P to feed the paper sheets loaded in the paper cassette 102 one by one to delivery rollers 147 and 148 is provided within the housing 101.

The first driving section 110 includes a feed mechanism 120 and a printer engine 130. The feed mechanism 120 feeds a paper sheet to the printer engine 130 (FIG. 3) and includes a pickup roller 121 and feed rollers 122 to 125. The pickup roller 121 picks up the paper sheets loaded in the paper cassette 102 one by one. The feed rollers 122 to 125 convey the picked-up sheets to the printer engine 130. The printer engine 130 includes a developing unit 131 and a transfer roller 136. The developing unit 131 contains a toner therein and includes a photoconductive drum 132, a charging roller 133, a developing roller 134, and a supply roller 135. The photoconductive drum 132, charging roller 133, developing roller 134 and supply roller 135 are driven together in mesh by the engagement of gear teeth and their overall driving torque varies depending on the driving hours. In other words, the developing unit 131 is replaced when the toner contained therein is completely consumed. The driving torque of the developing unit 131 is highest immediately after replacement and is gradually reduced with the reduction of the residual toner amount.

As generally known in the art, a laser beam generated from an exposure unit 105 is emitted to the photoconductive drum 132 to form an electrostatic latent image. The charging roller 133 applies a uniform electric charge to the surface of the photoconductive drum 132. The developing roller 134 attaches toner to the photoconductive drum 132 to develop the electrostatic latent image, thereby producing a visible developed toner image. The supply roller 135 supplies the toner to the developing roller 134. The transfer roller 136 transfers the toner image formed on the photoconductive drum 132 onto a paper.

The second driving section 140 includes a fusing unit 141 and a delivery mechanism 144 including a plurality of delivery rollers 145 to 148. The toner image is fused and stuck onto the paper passing through the printer engine 130 by the heat and pressure applied from the fusing unit 141. The fusing unit 141 includes a heating roller 142 and a pressure roller 143. The delivery rollers 145 to 148, which are positioned at the rear of the fusing unit 141 on the paper path P, discharge the paper to the outside of the housing 101 of the image forming apparatus 100.

The first motor 150 drives the first driving section 110. Since the first motor 150 should drive the pickup roller 121, feed rollers 122 to 125, photoconductive drum 132, charging roller 133, developing roller 134, supply roller 135 and transfer roller 136 of the first driving section 110, a brushless DC (BLDC) motor having a small size and a high output is employed as the first motor.

The second motor 160 drives the second driving section 140. As the second motor to drive the heating roller 142, pressure roller 143 and delivery rollers 145 to 148 of the second driving section 140, a stepping motor having a lower output and a superior control characteristic is employed.

The power supplier 170 supplies electric power to the first and second driving motors 150 and 160.

The sensor 180 positioned on the paper path P detects a jam of a paper being fed along the paper path P and sends a corresponding signal to the controller 190.

The controller 190 controls the power supplied to the first and second motors 150 and 160 from the power supplier 170 according to the signal received from the sensor 180. Since the first and second motors 150 and 160 have different outputs, they are stopped at different points in time when the powers supplied to the two motors 150 and 160 are cut off simultaneously.

Figure 4:
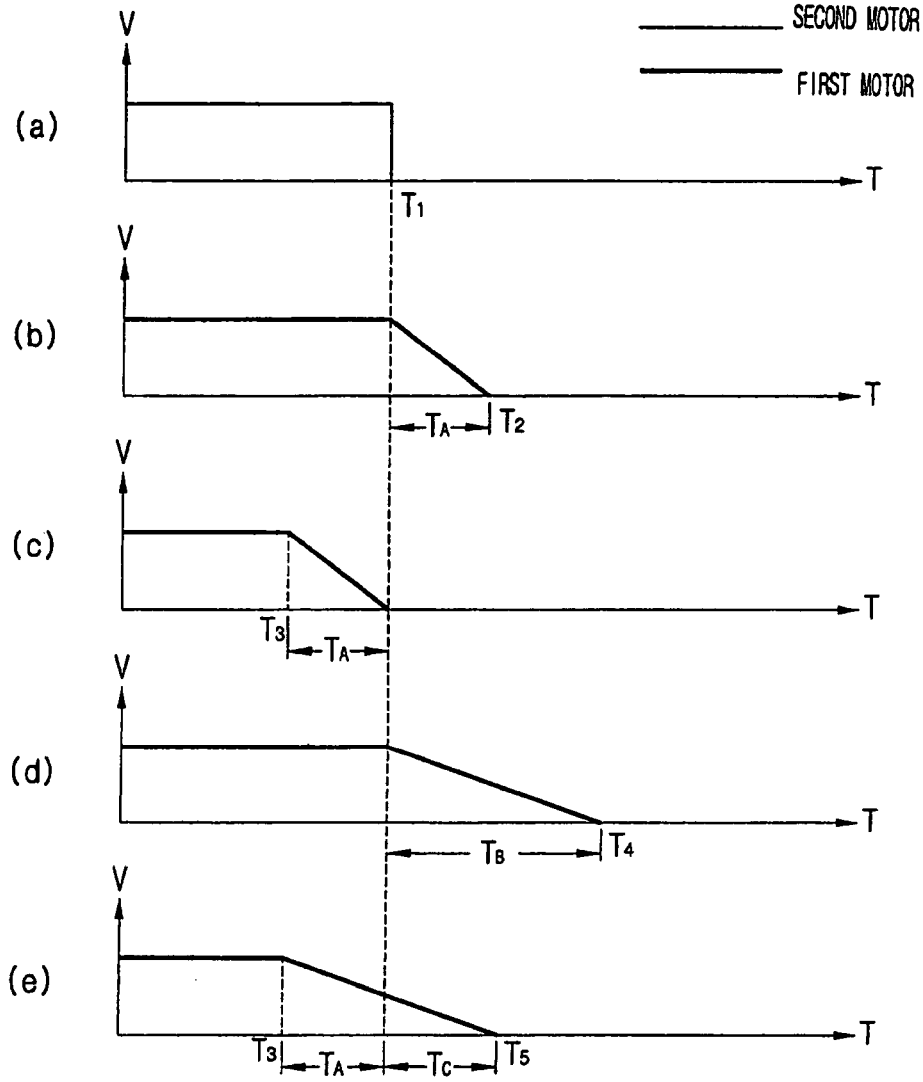
FIG. 4 illustrates graphs showing a process of controlling the driving of an image forming apparatus according to the embodiment of the present invention.

As shown in FIG. 4, if the powers supplied to the first and second motors 150 and 160 are cut off at time $T_1$, the second motor 160 having a low output and little inertial force will stop immediately at $T_1$ (see FIG. 4, part (a)), while the first motor 150 having a high output and great inertial force will slowly reduce its driving speed and stop at time $T_2$ (see FIG. 4, part (b)). Accordingly, there will be a time difference $T_A$ between $T_2$ at which the first motor 150 stops and $T_1$ at which the second motor 160 stops. The paper passing along the paper path P may be wrinkled (see W in FIG. 2) when it contacts both the printer engine 130 and the fusing unit 141. In such an event, the toner image transferred onto the paper is blurred, thereby deteriorating the printing quality.

In order to solve this problem, the controller 190 controls the power supplied to the first motor 150 to be cut off earlier than the power supplied to the second motor 160. As shown in FIG. 4, part (c), the power supplied to the first motor 150 is cut off earlier by the compensation time $T_A$ than the cut-off time $T_1$ of the power supplied to the second motor 160. Consequently, the first and second motors 150 and 160 can be stopped concurrently at $T_1$.

The compensation time $T_A$ can be determined by measuring the inertial force of the first motor 150, which refers to additional rotation of the first motor 150 after power cut-off. The additional rotation of the first motor 150 depends on the driving load of the first driving section 110 which also depends on the driving torque of the developing unit 131. Table 1 shows the additional rotation (mm) of the first motor 150 according to the driving torque of the developing unit 131 when a paper is conveyed along the paper path P at a speed of 120 mm/sec.

TABLE 1

| | Driving torque of developing unit (kgf/cm) | | | | |
|---|---|---|---|---|---|
| | 9 | 8 | 7 | 6 | 5 |
| Additional rotations (mm) | 3.0 | 3.5 | 4.2 | 5.8 | 7.6 |

As is clear from Table 1, the additional rotation of the first motor 150 increases with the reduction of the driving torque of the developing unit 131. The compensation time $T_A$ is determined based on the additional rotation (3 mm) at the highest driving torque 9 kgf/cm. Therefore, the compensation time $T_A$ is 3/120 sec. The controller 190 controls the power supplied to the first motor 150 to be cut off earlier by $T_A$ than the power supplied to the second motor 160 so that the first and second motors 150 and 160 can be stopped simultaneously.

Hereinbelow, the functions of the image forming apparatus and the method of driving the apparatus will be explained in more detail. It is assumed that the printing process of the image forming apparatus is performed at a speed of 120 mm/sec.

As shown in FIG. 2, when a command to print is input to the image forming apparatus, the charging roller 133 applies a uniform electric charge to the surface of the photoconductive drum 132. Also, a laser beam generated from the exposure unit 105 (see FIG. 1) is emitted to the surface of the photoconductive drum 132 to form an electrostatic latent image. The developing roller 134 attaches a toner to the photoconductive drum 132 to develop the electrostatic latent image, thereby producing a toner image. In addition, papers loaded in the paper cassette 102 (see FIG. 1) are fed one by one to the developing unit 131 by the pickup roller 121 and the feed rollers 122 to 125. When a paper passes between the photoconductive drum 132 and the transfer roller 136, the toner image formed on the photoconductive drum 132 is transferred onto the paper. The paper with the transferred toner image passes through the fusing unit 141 and is finally discharged out by the delivery rollers 145 to 148.

When a paper jam occurs during the printing process, the sensor 180 (see FIG. 3) detects the jam and sends a corresponding signal to the controller 190. Upon receiving the signal, the controller 190 cuts off the power supplied to the first motor 150 earlier by 3/120 sec than the power cut-off for the second motor 160. If the driving torque of the developing unit 131 is 9 kgf/cm, the stop point of the first motor 150 will be the same as that of the second motor 160 as shown in. FIG. 4, part (c).

If the driving torque of the developing unit 131 is reduced to 5 kgf/cm, the time to stop the first motor 150 will be delayed by $T_B$. Consequently, the first motor 150 will stop at $T_4$ (FIG. 4, part (d)). If the power supplied to the first motor 150 is cut off earlier by $T_A$ than the power supplied to the second motor 160, the first motor 150 will stop at $T_5$ and the time difference between the stop point of the first motor 150 and that of the second motor 160 will be reduced to $T_C$ as shown in FIG. 4, part (e). When the driving torque of the developing unit 131 is 5 kgf/cm, the first motor 150 additionally rotates by 7.6 mm. It is possible to reduce the additional rotation of the first motor 150 to 4.6 mm by cutting off the power supplied to the first motor 150 earlier by 3/120 sec.

As a result, the paper wrinkling W as shown in FIG. 2 can be reduced, thereby improving the printing quality.

The image forming apparatus as described above is a so-called electrophotographic image forming apparatus which develops an electrostatic latent image formed on the photoconductive drum 132 by a laser beam emitted from the exposure unit 105 to produce a toner image and transfers the toner image onto a printing paper. However, the present invention is not limited only to the above image forming apparatus. The present invention is also applicable to any image forming apparatus with various printing methods, such as ink-jet printing.

The embodiment of the present invention as described above provides an image forming apparatus which realizes an optimized driving mechanism by adopting both a motor with a high output and a motor with a superior control characteristic and appropriately controlling the driving of the two motors.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a first driving section having a feed mechanism;

a second driving section having a delivery mechanism;

a first motor to drive the first driving section;

a second motor having an output different from the first motor to drive the second driving section; and a controller to control a power supplied to one of the first and second motors having a higher output to be cut off earlier by a predetermined compensation time than a power supplied to the other one of the first and second motors having a lower output when stopping the first and second motors, wherein the first and second motors stop concurrently the compensation time is equal to or shorter than a difference $|T_1-T_2|$ between a first stop time $T_1$ required to actually stop the first motor after cut-off of the power supplied to the first motor and a second stop time $T_2$ required to actually stop the second motor after cut-off of the power supplied to the second motor.

2. The image forming apparatus according to claim 1, wherein the first motor has a higher output than the second motor.

3. The image forming apparatus according to claim 2, wherein the first motor is a brush less DC motor (BLDC) motor and the second motor is a stepping motor.

4. The image forming apparatus according to claim 1, wherein the printer engine includes a photoconductive drum, a developing roller and a transfer roller, and the second driving section further includes a fusing roller.

5. A method of driving an image forming apparatus which comprises a first motor to drive a first driving section including a feed mechanism and a second motor having an output different from the first motor to drive a second driving section including a delivery mechanism, the method comprising:

stopping the first and second motors, comprising controlling a power supplied to one of the first and second motors having a higher output to be cut off earlier by a predetermined compensation time than a power supplied to the other of the first and second motors having a lower output, wherein the first and second motors stop concurrently, and the compensation time is equal to or shorter than a difference $|T_1-T_2|$ between a first stop time $T_1$ required to actually stop the first motor after cut-off of the power supplied to the first motor and a second stop time $T_2$ required to actually stop the second motor after cut-off of the power supplied to the second motor.

6. The method according to claim 5, further comprising culling off the power supplied to the first motor earlier than the power supplied to the second motor.

7. The method according to claim 6, wherein the first motor is a BLDC motor and the second motor is a stepping motor.

8. The method according to claim 5, wherein the printer engine includes a photoconductive drum, a developing roller and a transfer roller, and the second driving section further includes a fusing roller.

9. An image forming apparatus comprising:

a first motor to receive a first power and having a first output;

a second motor to receive a second power and having a second output lower than the first output;

a controller to cut off the first and second powers at different times so that the first and second motors stop concurrently;

a feed mechanism to feed a recording medium, wherein the first motor drives the feed mechanism;

a printer engine to receive the fed recording medium and form an image thereon, the printer engine being driven by the first motor; and a delivery unit to receive the recording medium from the printer engine and discharge the received recording medium to an outside, wherein the feed mechanism comprises a pickup roller to pick up the recording medium and a feed roller to convey the picked up recording medium to the printer engine.

10. The image forming apparatus according to claim 9, wherein the printer engine comprises:

a photoconductive drum having a latent image thereon;

a developing roller to develop the latent image with a toner; and a transfer roller to transfer the developed latent image to the recording medium to form the formed image on the recording medium.

11. An image forming apparatus comprising:

a first motor to receive a first power and having a first output;

a second motor to receive a second power and having a second output lower than the first output;

a controller to cut off the first and second powers at different times so that the first and second motors stop concurrently;

a feed mechanism to feed a recording medium, wherein the first motor drives the feed mechanism;

a printer engine to receive the fed recording medium and form an image thereon the printer engine being driven by the first motor; and a delivery unit to receive the recording medium from the printer engine and discharge the received recording medium to an outside, wherein the controller cuts off the first and second powers in response to the detected jam.

* * * * *

UNITED STATES PATENT AND TRADEMARK OFFICE

CERTIFICATE OF CORRECTION

PATENT NO. : 7,356,285 B2
APPLICATION NO. : 10/974786
DATED : April 8, 2008
INVENTOR(S) : Young-min Kim et al.

It is certified that error appears in the above-identified patent and that said Letters Patent is hereby corrected as shown below:

Column 6, Line 41, change “culling” to --cutting--.

Column 8, Line 7, after “thereon” insert --,--.

Signed and Sealed this

Twenty-sixth Day of August, 2008

JON W. DUDAS
*Director of the United States Patent and Trademark Office*